US006283428B1

(12) United States Patent
Maples et al.

(10) Patent No.: US 6,283,428 B1
(45) Date of Patent: Sep. 4, 2001

(54) SWING ARM MOUNT SYSTEM

(75) Inventors: Elbert R. Maples, Nashville; Barry Becker, Fairview, both of TN (US)

(73) Assignee: Military Systems Group, Inc., Nashville, TN (US)

( * ) Notice: Subject to any disclaimer, the term of this patent is extended or adjusted under 35 U.S.C. 154(b) by 0 days.

(21) Appl. No.: 09/443,560

(22) Filed: Nov. 19, 1999

(51) Int. Cl.[7] ..... E04G 3/00
(52) U.S. Cl. ..... 248/282.1; 42/94
(58) Field of Search ..... 248/282.1, 291.1, 248/276.1; 42/94; 224/420

(56) References Cited

U.S. PATENT DOCUMENTS 3,550,892 * 12/1970 Prost ..... 248/282.1
5,379,205 * 1/1995 Peng ..... 248/276.1 X
5,626,322 * 5/1997 Braun ..... 248/282.1
6,119,994 * 9/2000 Price ..... 248/276.1

* cited by examiner

*Primary Examiner*—Ramon O. Ramirez
(74) *Attorney, Agent, or Firm*—Niro, Scavone, Haller & Niro

(57) ABSTRACT

A mount for securing a firearm to a motorized platform. The mount includes first and second mounting brackets and first and second support arms having opposing ends. The first mounting bracket is adapted to be secured to the motorized platform. The end of the first arm is rotatably connected to the first bracket to form a first rotation point. The first and second support arms are also connected at the respective ends to form a second rotation point. A third rotation point is further formed by rotatably connecting the second mounting bracket to an end of the second support arm. The rotation points allow the firearm to be moved into a plurality of firing positions.

3 Claims, 5 Drawing Sheets

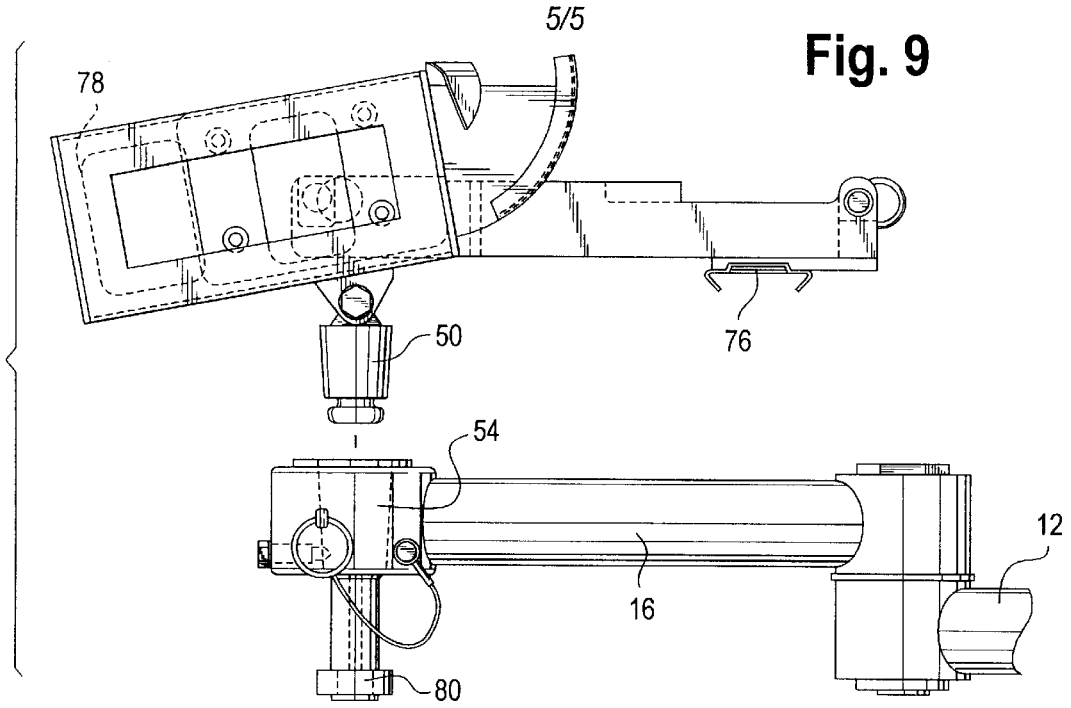
Fig. 9
Fig. 10
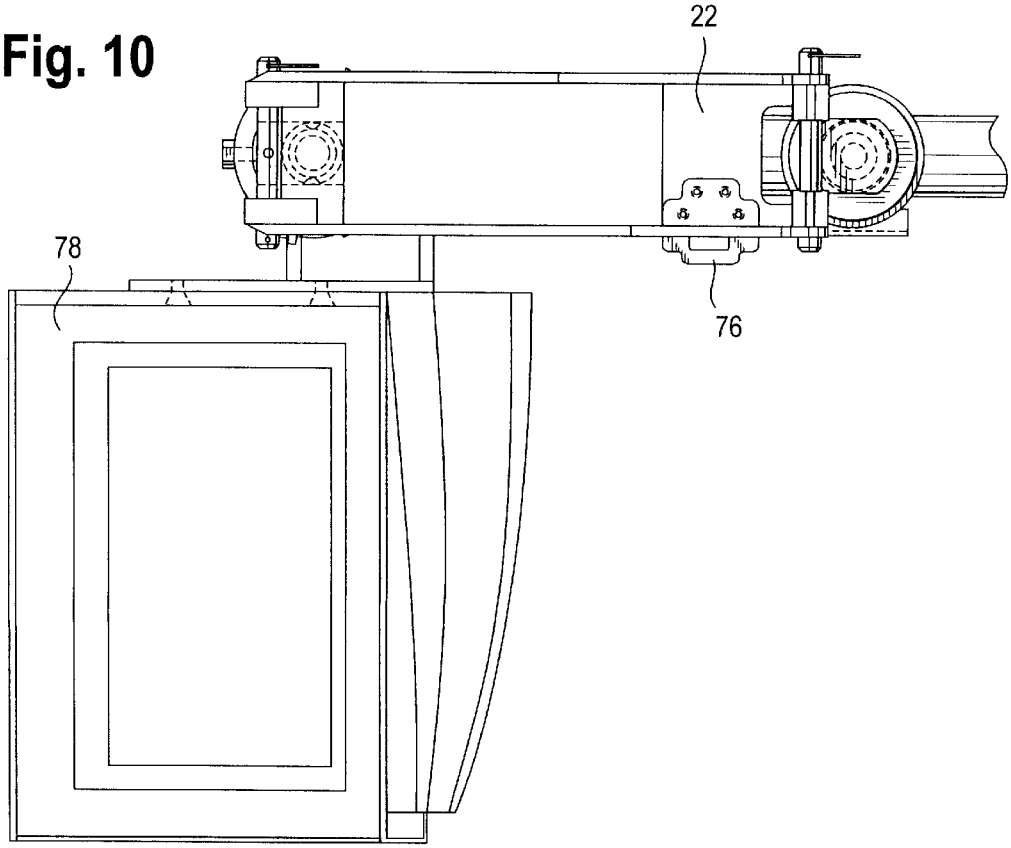

SWING ARM MOUNT SYSTEM

BCAKGROUND OF THE INVENTION

The device of the present invention relates to a gun mount for affixing a firearm to a vehicle, boat or other platform.

SUMMARY OF THE INVENTION

When mounting a firearm such as a machine gun to a vehicle, boat or other platform it is desirable to provide a mount which will allow the firearm to be fired while facing towards the front of the platform and to be quickly and easily repositioned to a sideways and/or rearward facing position while still supporting and retaining positive control over the firearm. However, such repositioning about a single axis often requires the firearm to swing in an arc of greater that 90 degrees past a corner post or other obstruction, which may interfere with the movement of the weapon. In addition, such repositioning about a central axis may also require the operator to also reposition himself often into an inaccessible position in order to maintain a proper sightline for aiming the weapon.

The present invention solves the problems typically associated with weapon mounts having a central axis by providing two support arms interposed between a platform support bracket and a weapon support bracket. In addition, a plurality of rotational points are used which a permit the weapon to be positionable about the platform corner post while permitting the operator to maintain a stationary position in the platform.

BRIEF DESCRIPTION OF THE DRAWINGS

These and other features, objects and advantages of the present invention will become apparent from the following description and drawings wherein like reference numerals represent like elements in the several views, and in which:

FIG. 9 is a side view of an alternate embodiment of the present invention; and FIG. 10 is a top view of the embodiment shown in FIG. 9.

DESCRIPTION OF THE PREFERRED EMBODIMENTS

Set forth below is a description of what are currently believed to be the preferred embodiments or best examples of the invention claimed. Future and present alternatives and modifications to the preferred embodiments are contemplated. Any alternates or modifications in which insubstantial changes in function, in purpose, in structure or in result are intended to be covered by the claims of this patent.

Figure 1:
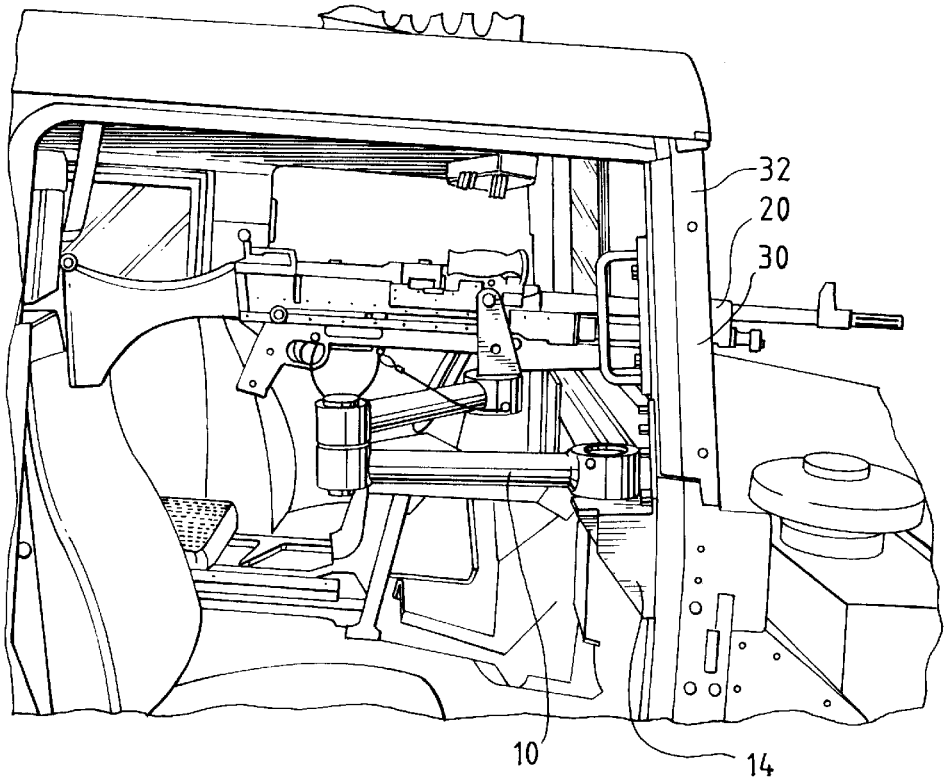
FIG. 1 shows how one embodiment of the present invention permits a weapon to be located in a forward facing position in a platform.
Figure 2:
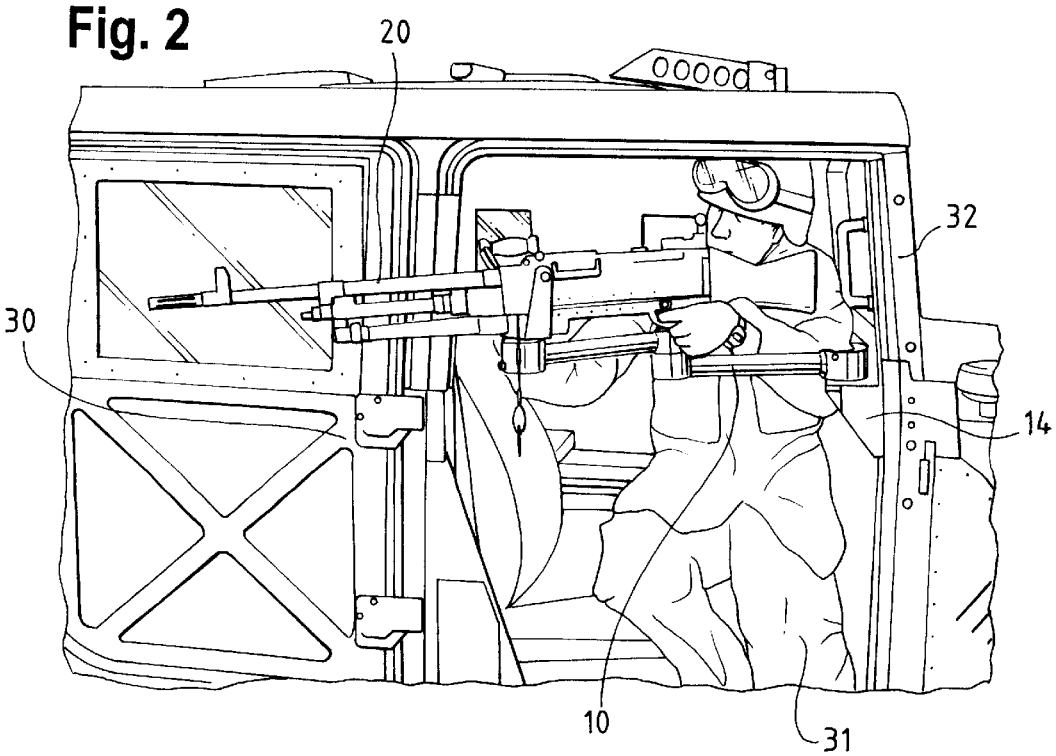
FIG. 2 shows how a rearward facing position may be accomplished with the embodiment shown in FIG. 1
Figure 3:
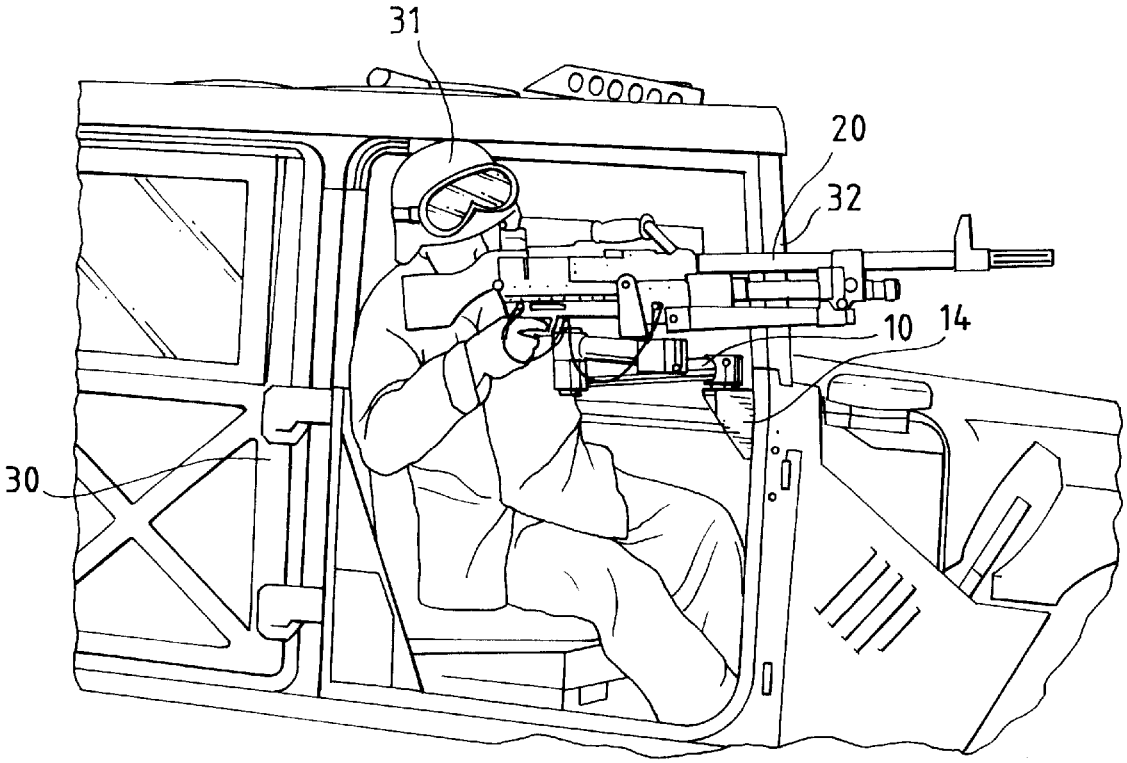
FIG. 3 shows how a sideways facing position may be attained with the present invention.
Figure 4:
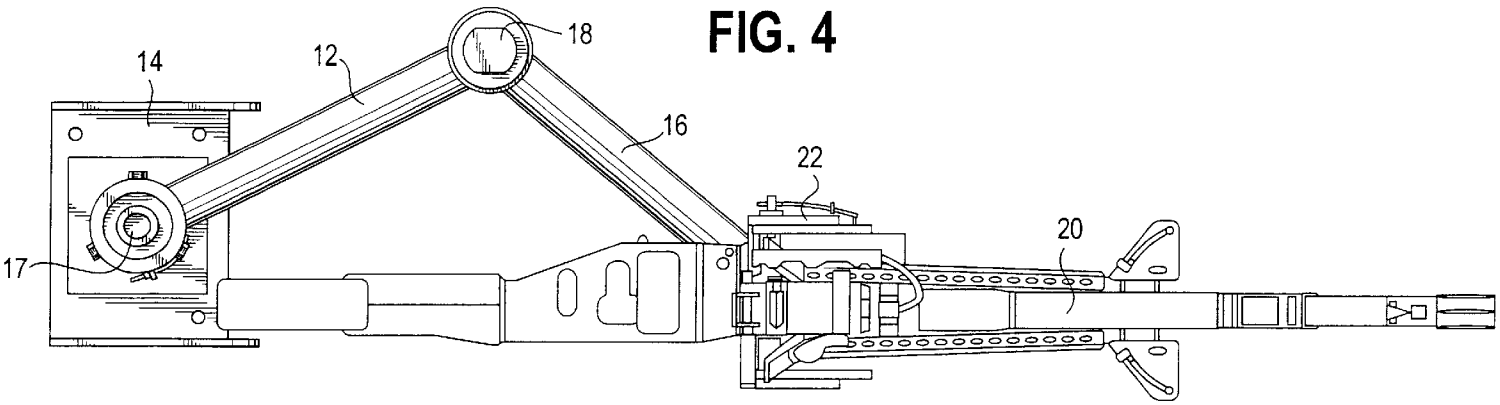
FIG. 4 shows a top view of one embodiment of the present invention.
Figure 5:
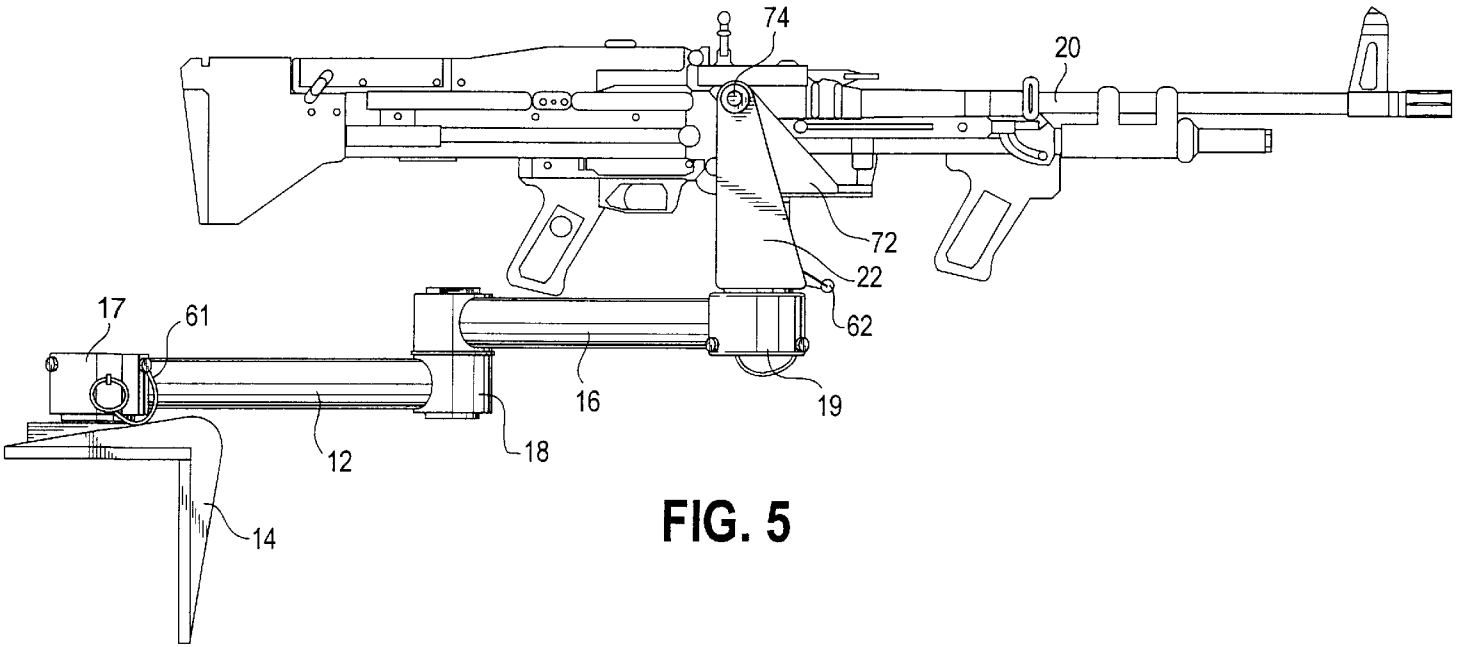
FIG. 5 shows a side view of the embodiment shown in FIG. 4.
Figure 6:
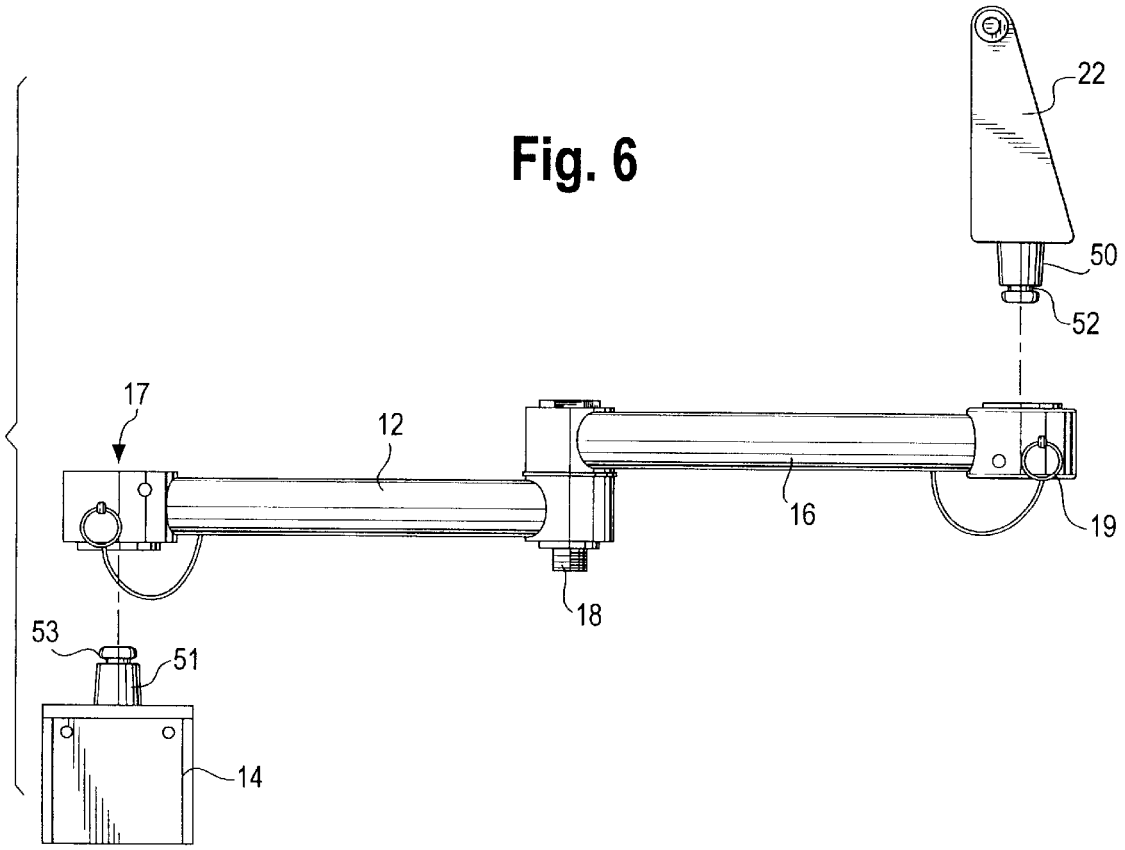
FIG. 6 is a side view showing how pintle and socket assemblies are used with the present invention.

As shown in FIGS. 1–3, the weapon mount 10 of the present invention permits a weapon 20 to be positioned from a forward facing position in a vehicle 30 to a rearward or sideways facing position without interference from vehicle corner post 32. In addition, operator 31 may operate and reposition the weapon 20 while remaining in a generally fixed location in the vehicle.

As shown in FIGS. 4–10, the present invention includes a first support arm 12 which is rotatably connected to a first support bracket 14 which is adapted to be affixed to vehicle 30. This forms a rotational point 17. A second support arm 16 is rotatably attached to arm 12 to form rotation point 18. Arm 12 may be located under arm 16 and longer in length than arm 16. Arm 16 is, in turn, rotatably connected to a gun mount 22 to form rotation point 19. Gun mount 22 may consist of a carriage 23 and cradle 72.

Figure 7:
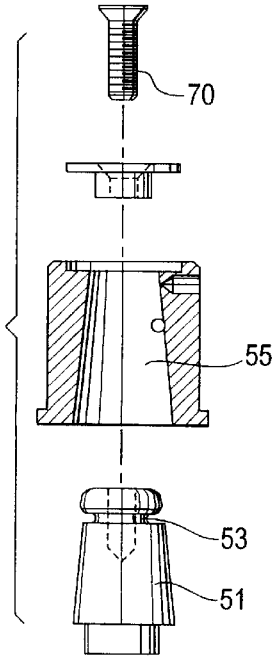
FIG. 7 is a partial, exploded cross-sectional view of a pintle and socket assembly.
Figure 8:
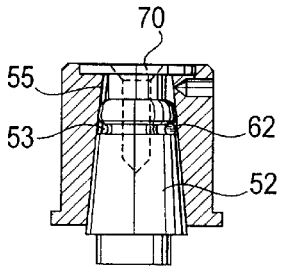
FIG. 8 shows an assembled pintle and socket assembly.

As shown in FIGS. 6–9, rotation points 17 and 19 may be made from pintles 50 and 51 which have annular grooves 52 and 53 respectively. Pintles 50 and 51 are truncated-cones in shape and are sized to fit within corresponding sockets 54 and 55, as shown in FIGS. 7–9. Locking pins 61 and 62 secure the pintles within the sockets by being inserted into the annular grooves which allows for the quick and easy installation of the device and firearm. Fastener 70 may also be provided for further support. Of course, persons of skill in the art would also know that there are many equivalent structure to the pintle and socket assemblies and that such structures may be used to create the rotation points as well.

Weapon 20 may be mounted in cradle 72 which is pivotally connected to carriage 23 of gun mount by pin 74. An ammo can clip 76, and additional ammo can 78 may also be provided. Lastly, a windshield guide pad 80 may also be provided which rest against the windshield base.

In use, as shown in FIG. 1, weapon 20 may be placed in a forward facing position with the plurality of rotation points 17–19 allowing the operator to aim the weapon in a wide arc. In addition, rotation points 17–19, and the ability of arm 16 to be fully rotated about arm 12, permits the weapon's location to be moved from a forward facing location to either a sideways or rearward location without interference from corner post 32. As also shown, the operator may also stay within a generally stationary position in the platform while positioning and operating the weapon from the above described locations. This generally permits an operator to use the support provided by the mount in an unobstructed field of fire that is nearly comparable to the use of the weapon without the targeting aid of a weapon support.

While the invention has been described with reference to the preferred embodiments thereof, it will be appreciated that numerous variations, modifications, and alternate embodiments are possible, and accordingly, all such variations, modifications, and alternate embodiments are to be regarded as being within the spirit and scope of the invention.

What is claimed is:

1. A device for securing a firearm to a vehicle comprising:

first and second support arms rotatably connected;

a vehicle mounting bracket adapted to be secured to a vehicle;

said first support arm rotatably connected to said vehicle mounting bracket by a truncated pintle and socket assembly;

a gun mount adapted to receive a firearm;

said gun mount rotatably connected to said second support arm by a truncated pintle and socket assembly.

2. The device of claim 1, wherein said first support arm is located below said second support arm.

3. The device of claim 1 wherein said first support arm is of greater length than said second support arm.

* * * * *